US008025462B2

(12) United States Patent
Gleadowe

(10) Patent No.: US 8,025,462 B2
(45) Date of Patent: Sep. 27, 2011

(54) DISPLACEABLE PLATFORM STRUCTURE AND METHOD OF THE DISPLACEMENT THEREOF

(75) Inventor: John R. Y. Gleadowe, Falmouth (GB)

(73) Assignee: Fugro Seacore, Ltd., Cornwall (GB)

( * ) Notice: Subject to any disclaimer, the term of this patent is extended or adjusted under 35 U.S.C. 154(b) by 604 days.

(21) Appl. No.: 10/592,843

(22) PCT Filed: Mar. 14, 2005

(86) PCT No.: PCT/GB2005/001032

§ 371 (c)(1),
(2), (4) Date: Oct. 21, 2008

(87) PCT Pub. No.: WO2005/090688

PCT Pub. Date: Sep. 29, 2005

(65) Prior Publication Data

US 2009/0042466 A1 Feb. 12, 2009

(30) Foreign Application Priority Data

Mar. 16, 2004 (GB) ..... 0405863.2

(51) Int. Cl.
*E02B 17/08* (2006.01)

(52) U.S. Cl. ..... 405/196; 405/201; 405/221

(58) Field of Classification Search ..... 405/196–201, 405/218, 221

See application file for complete search history.

(56) References Cited

U.S. PATENT DOCUMENTS

| | | | | |
|---|---|---|---|---|
| 3,230,721 | A | 1/1966 | De Long et al. | 61/46.5 |
| 3,279,407 | A | 10/1966 | Stenger | 114/66.5 |
| 3,283,516 | A | 11/1966 | De Long et al. | 61/46.5 |
| 3,612,201 | A | 10/1971 | Smith | 180/8 E |
| 3,680,321 | A * | 8/1972 | Bordes | 405/201 |
| 3,734,220 | A | 5/1973 | Smith | 180/8 E |
| 4,270,877 | A | 6/1981 | Post | 405/198 |
| 4,288,177 | A | 9/1981 | Schoonmade | 405/196 |
| 4,343,570 | A | 8/1982 | Myer, II | 405/229 |
| 5,351,773 | A | 10/1994 | Yanagisawa | 180/8.5 |

FOREIGN PATENT DOCUMENTS

GB 1 289 700 9/1972

* cited by examiner

*Primary Examiner* — David Bagnell
*Assistant Examiner* — Benjamin Fiorello
(74) *Attorney, Agent, or Firm* — Brinks Hofer Gilson & Lione

(57) ABSTRACT

A displaceable load carrying structure characterized by a main support arrangement (3), first and second sets (4, 5, 6, 7, & 8, 9, 10, 11) of support legs for supporting the main support arrangement (3) said support legs being vertically movable between raised and lowered positions relative to the main support arrangement, characterized in that each such set (4, 5, 6, 7, & 8, 9, 10, 11) of legs is capable of displacement as a set between said raised positions and said lowered positions and displaced relative to the other set while the legs of the other set (8, 9, 10, 11, or 4, 5, 6, 7) are in their lowered main support arrangement (3) supporting positions.

19 Claims, 6 Drawing Sheets

DISPLACEABLE PLATFORM STRUCTURE AND METHOD OF THE DISPLACEMENT THEREOF

This invention relates to load carrying platform structures that are operationally displaceable from one operational location to another, and which are particularly applicable for supporting a load carrying platform above a body of water such as the open sea, above a river or estuary in such manner that the platform may be operationally positioned at required locations above the body of water.

FIELD OF INVENTION

In particular the present invention lies in the field of structures that can be moved from one operational location to another as required for transporting loads and/or personnel from one location to another.

A particular application of the invention is to structures that can be used for mining or other operations in a body of water such as the sea and/or for transporting personnel as and when required between locations at sea or to and from the shore.

BACKGROUND

It is well known to carry out mining operations in a sea bed particularly along a continental shelf or other bodies of water that are shallow enough for support structures of the kind that have a number of upstanding legs resting upon the bottom of a body of water connecting with a frame construction supporting a platform, the legs being so associated with the frame construction as to be separately displaceable relative to the frame construction by a combination of individual lifting/lowering movements together with horizontal movements of the platform the result of which moves the structure from one user location to another.

As is indicated above a particular use of such structures is to undersea mining activities that are in practice carried out from the platform which as mentioned is located above the water body surface, i.e., the sea surface.

Undersea mining activities involve a number of different modes of operation that require equipment located above water level for controlling apparatus that is in operation submerged and designed for performing a required under seas mining operation

OBJECTS OF THE INVENTION

It is an object of the invention to provide a support structure suitable for use in load carrying and/or transportation activities, for example, personnel transportation that incorporate facilitates for enabling the operational positioning of the structure with respect to a required location of use.

STATEMENTS OF THE INVENTION

According to a first aspect of the invention there is provided displaceable load carrying structure for supporting a load on or above a body of water, characterised in that the platform structure incorporates first and second sets of support legs vertically movable between raised and lowered positions relative to the platform structure, and in that when the legs of one set are in their lowered position they are capable of supporting the platform whilst the legs of the other set are in their raised positions.

A further aspect of the invention provides a displaceable load carrying structure characterised by a main support arrangement, first and second sets of support legs for supporting the main support arrangement, said support legs being vertically movable between raised and lowered positions relative to the main support arrangement, characterised in that each such set of legs is capable of displacement as a set between said raised positions and said lowered positions and displaced relative to the other set whilst the legs of the other set are in their lowered main support arrangement supporting positions.

In a preferred construction when the support legs of one set are in their raised positions the main support arrangement together with the raised support legs are displaceable from a first location of use to another location whilst the other support legs remain in their lowered position.

Preferably, the main frame support includes two side by side spaced apart main support rails, and in which a pair of support legs of the first set and a pair of support legs of the second set are associated with each main support rail, said pairs of legs being located on opposed sides of the rails.

In a further preferred construction the support legs and the main support frame are relatively displaceable relative to each other along the elongate direction of the main support frame.

A further aspect of the invention provides a method of displacing a load carrying structure from one location at which the structure is being supported by all sets of support legs to another location, characterised by the sequence of steps of vertically displacing the legs of one set of support legs from their structure supporting lowered position, displacing the raised legs relative to the other set of legs towards the desired another location relative to the main support arrangement, returning the raised legs to their structure supporting lowered positions, vertically displacing the other set of support legs from their supporting lowered positions to their raised positions, displacing the raised support legs together with the main support arrangement towards the another location, and then lowering the raised support legs to their lowered main support arrangement supporting position.

Conveniently, the support legs are provided with frame construction mounting means adapted to enable raising and lowering of the sets of legs relative to the frame construction and to enable selective displacement of the frame construction in a predetermined direction relative to the frame construction whilst one set of legs is raised and the outer is frame construction supporting.

Broadly according to a further aspect of the present invention there is provided a load transportation structure incorporating a frame construction mounting a load carrying platform, first and second sets of frame construction support legs, the sets of legs being selectively alternately operable such manner as to enable displacement of the frame construction from one location of use to another location of use whilst maintaining support of the platform and its load.

Broadly according to a further aspect of the invention there is provided a movable load support structure for supporting a load above a body of water, including first and second sets of legs for supporting the frame construction and so connected with the frame construction as to be capable of lifting, lowering and translating movements in said predetermined direction relative to the frame construction, the arrangement being such that suitable sequences of these movements enables displacement of the structure in the predetermined direction whilst maintaining at all times symmetrical support of the platform during movement of the structure relative to the body of water.

In accordance with a still further aspect of the invention there is provided a method of moving structures which have two sets of legs for supporting a frame construction carrying a load carrying platform in which method when it is required to move the structure in a required direction from one user location to another location a cycle of operations is carried out including raising one set of legs from a load carrying position, displacing the raised legs together with the frame construction by a predetermined extent of travel along said direction, returning the raised legs to their load supporting setting, raising the other set of legs from their load supporting setting and displacing these legs together with the frame construction a predetermined extent of travel in said direction and returning said other set of legs is returned to the load supporting setting.

Conveniently, the sequence of operations is repeated until the structure has been moved from one location to another.

BRIEF DESCRIPTION OF THE DRAWINGS

For a better understanding of the invention and to show how to carry the same into effect reference will now be made to the accompanying drawings in which: —

FIG. 1 illustrates the support structure in an operational position in which all of the legs of the two sets associated with the structure are lowered or being lowered to take the weight of the overall structure;

FIG. 6 illustrates the support structure when both the outer and inner sets of legs are in their frame construction supporting positions, this being the same position as illustrated in FIG. 1 and thus representative of a complete cycle of operations.

DETAILED DESCRIPTION OF THE DRAWINGS

Figure 1:
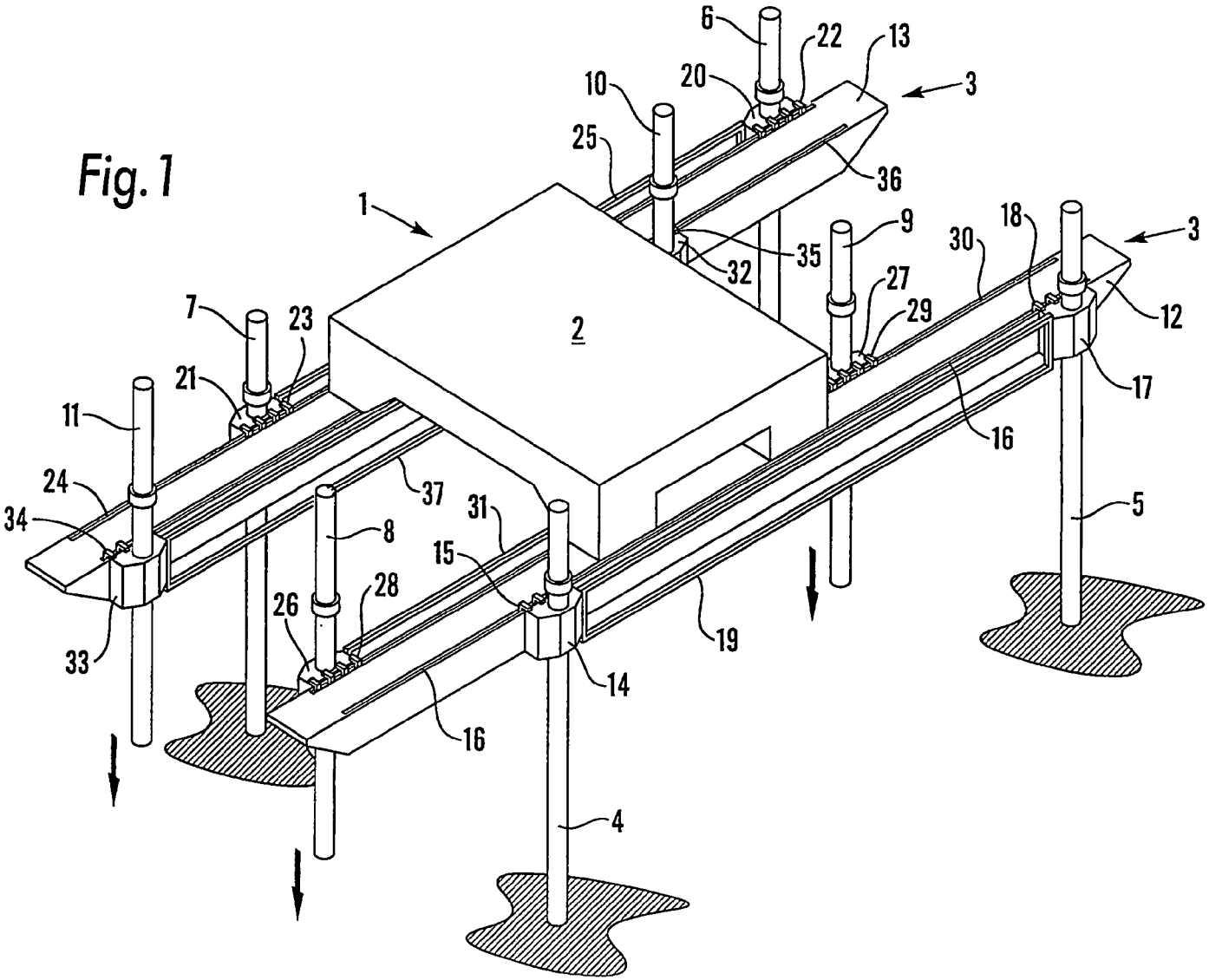
FIGS. 1, to 6 schematically illustrate a load support and load transportation structure incorporating a load carrying platform mounted upon a frame construction carried by inner and outer sets of frame construction support legs for supporting the platform above a body of water and in particular: —

Referring now to FIG. 1 which is a schematic representation of a support structure 1 including a platform 2 mounted upon a frame construction 3 that is itself carried by a plurality of legs 4 to 11.

These legs can be conveniently regarded as comprising an outer set of legs 4,5,6 and 7 and an inner set of legs 8,9,10 and 11.

The frame construction 3 can be conveniently regarded as comprising two parallel spaced apart main elongate support rails 12 and 13 that serve actually to support the platform 2.

The leg 4 is mounted to the support rail 12 by way of a carriage 14 that includes upper and lower elements 15 (only the upper elements being shown) that respectively engage with upper and lower guide rails or tracks 16 (only the upper rail or track being shown) provided upon the adjacent side region of the support rail 12.

The outer leg 5 is similarly mounted to the main rail 12 by a carriage 17 having a construction and operation similar to that of the carriage 14 whereby upper and lower elements 18 engage with the guide rails or tracks 16.

Means (not shown) are provided in or in connection with the carriage 14 whereby relative length ways movement can be produced between the guide rails or tracks 16 and the carriage 14 and also such that the associated outer leg 4 can be vertically raised or lowered with respect to the carriage and thus the main rail 12.

The two carriages 14 and 17 are maintained in a fixed separation by a frame assembly 19.

With this arrangement the horizontal separation of the two carriages 14 and 17 is set. It should be noted however that the legs 4 and 5 are independently operable height ways so as to be able to accommodate an uneven sea floor whilst to ensure that the platform is level in a horizontal plane.

In a similar manner the outer legs 6 and 7 are respectively mounted to the other main rail 13 by carriages 20 and 21 respectively including upper and lower elements 22 and 23 (only the upper elements being shown in each case) that respectively engage with upper and lower guide rails or tracks 24 (only the upper rail or track being shown) provided upon the adjacent side region of the support rail 13.

The two carriages can be maintained in a fixed relative separation by a frame assembly 25 that extends lengthways relative to the main rail 13.

As in the case of the carriages 14 and 17 means (not shown) are provided in or in connection with the carriages 20 and 21 whereby the carriages can be simultaneously caused to displace lengthways of the guide rails or tracks 25 and such that the associated outer legs 8 and 9 can be separately vertically raised or lowered with respect to the associated carriage and thus the main rail 13.

As has been mentioned above, the associated pairs of carriages 14,17; and 21,20 are inter-coupled to ensure synchronised movements length ways of the associated guide rails or tracks these carriages.

Whilst it is particularly required for the carriages to operate in pairs if desired arrangements may be made to enable the carriages to be independently relatively adjustable relative to the associated guide rails or tracks if it should be desired to adjust their separation to for, example, accommodate sea bed conditions.

The movements of the carriages 14,17, 20 and 21 relative to the main rails 12 and 13 and the vertical displacements of the outer legs 6 and 7 can be effected by any convenient means (not shown) such as hydraulically (by hydraulic piston and cylinder arrangements), mechanically (i.e., winch arrangements), electrically or by appropriate combinations thereof.

The inner legs 8 and 9 are mounted to the other side of the main rail 12 by carriages 26 and 27 each having respectively including upper and lower elements 28 and 29 (only the upper elements being shown in each case) that respectively engage with upper and lower guide rails or tracks 30 (only the upper rail or track being shown) provided upon the adjacent side region of the support rail 12 that is on the opposite side region of the rail 12 to guide track 16.

These two inner carriages 26 and 27 are maintained at a fixed separation by a frame assembly 31 that is arranged lengthways of the main frame 12.

The other inner legs 10 and 11 are mounted to the inside of the main rail 13 by carriages 32 and 33 each respectively including upper and lower elements 34 and 35 (only the upper elements being shown in each case) that respectively engage with upper and lower guide rails or tracks 36 (only the upper rail or track being shown) provided upon the adjacent side region of the main rail 13.

These two inner carriages 32 and 33 are maintained at a fixed separation by a frame assembly 37 that is arranged lengthways of the main frame 13.

As in the case of the carriages 14 and 17 means (not shown) are provided in or in connection with the carriages 32 and 33 whereby relative movement can be produced between the carriages and the guide rails or tracks 36 and such that the associated legs 10 and 11 can be separately vertically raised or lowered with respect to the associated carriage and thus the main rail 13.

Whilst, as has been mentioned above, the associated pairs of carriages 26,27 and 32,33 inter-coupled by the associated frame assemblies 31 and 37 to ensure synchronised movements length ways of the associated guide rails or tracks arrangements may be provided if desired to enable these carriages to be independently relatively adjustable to, for example accommodate sea bed conditions.

The relative movements between the carriages 26,27 and 32,33 and the main rails 12 and 13 and the vertical displacements of the inner legs 8,9,10 and 11 can be effected by any convenient means (not shown) such as hydraulically (i.e., by hydraulic piston and cylinder arrangements), mechanically (i.e., winch arrangements), electrically or by appropriate combinations thereof.

A possible sequence of operations involved in the displacement of the above discussed support structure 1 from one location to another will be considered in relation to the FIGS. 1 to 6 of the drawings.

Referring now to FIG. 1 it will be noted that the inner legs 8 and 11 are located adjacent to the left hand ends of the rails 12 and 13 and that the inner legs 9 and 10 are located inwardly of the other ends of the rails 12 and 13. At this point in the sequence of operations it is assumed that the outer legs 4,5,6 and 7 are engaging with the sea bed and that the inner legs 8,9,10 and 11 are, as indicated by the downwards directed arrows, finishing their lowering movements towards the seabed and thus their frame construction supporting positions.

Once the inner legs have been fully lowered the weight of the platform 2 and any load i.e., equipment located on the platform 2 will be totally supported by the two sets of inner and outer legs.

As has been mentioned when it is desired to displace the platform in a particular direction i.e., to the left as shown in the drawings from one location to another the inner and outer sets of legs are alternately raised and lowered and the frame displaced in what may be regarded as a cycle/sequence of operations.

Figure 2:
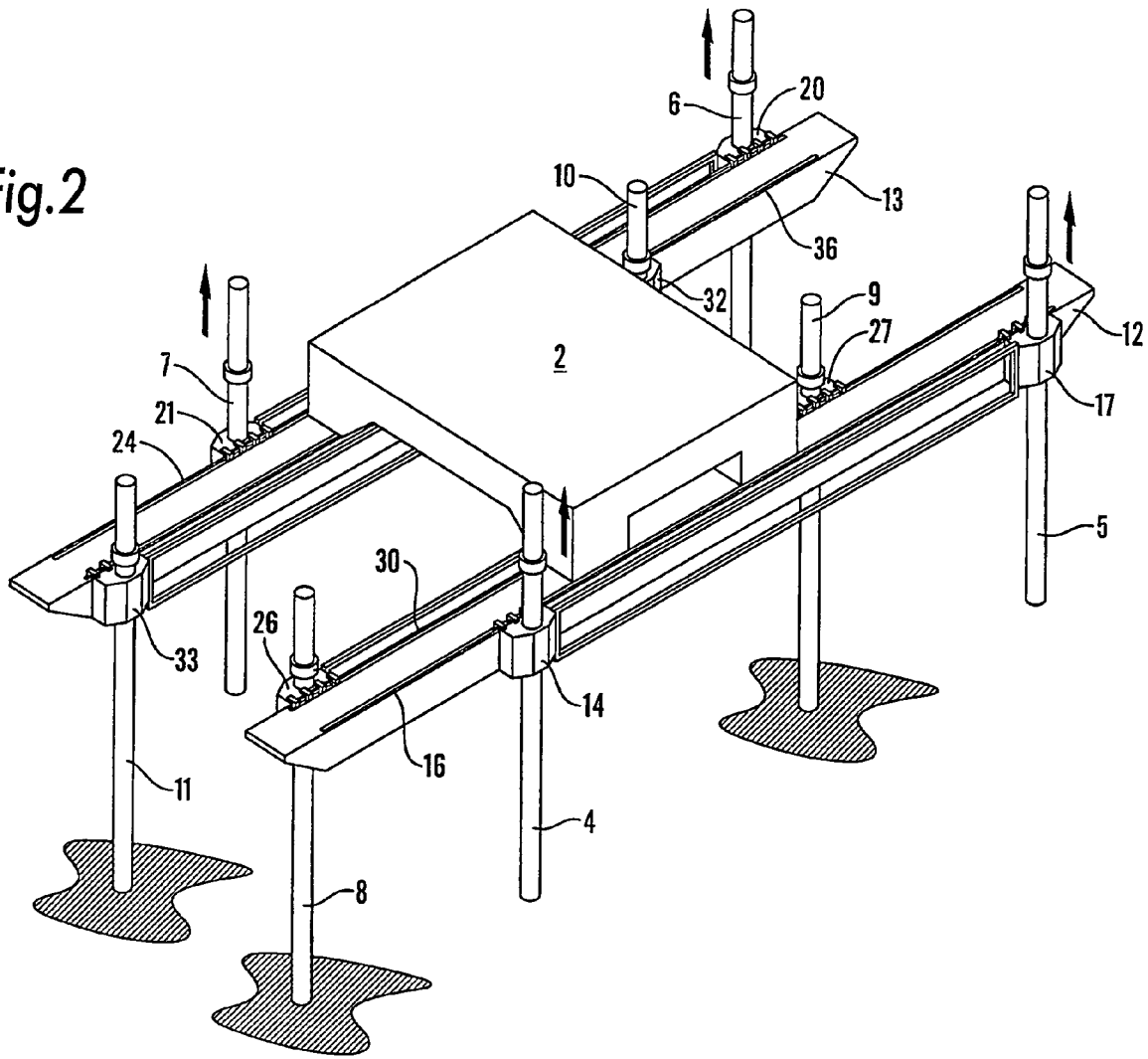
FIG. 2, illustrates the support structure when the inner legs are in their frame construction supporting positions and the outer legs are raised or being raised enabling displacement of the frame construction.

From the initial setting of the inner and outer sets of legs mentioned in relation to FIG. 1 the outer set of legs 4,5,6 and 7 is raised as is indicated by the arrows in FIG. 2. When the outer set of legs has been raised the frame construction 3 and the platform 2 will be supported solely by the inner set of legs 8,9,10 and 11.

Figure 3:
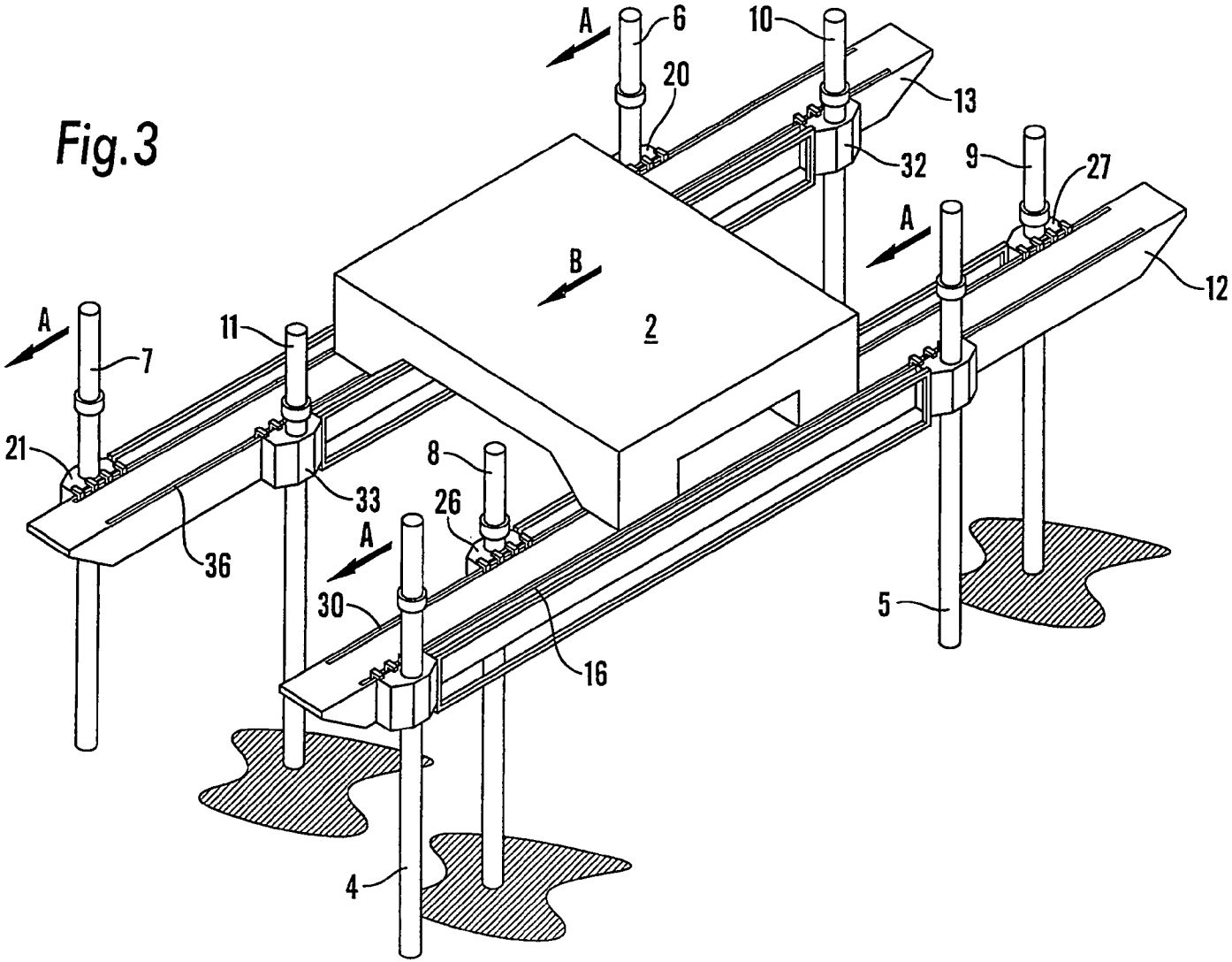
FIG. 3 illustrates the support structure when the inner set of legs are frame construction supporting and the outer legs are raised enabling displacement of the outer legs and the frame construction.

The carriages 26,27,32 and 33 associated with the inner set of legs 8,9,10 and 11 are actuated in such manner as to displace the set of outer legs 4,5,6 and 7 together with the frame construction main rails 12 and 13 and thus the platform and any load carried thereby in the direction indicated by the arrows until the outer legs 4,5,6 and 7 reach the end of their possible range of travel relative to the guides 16 and 24. FIG. 3 illustrates the position at a point at which the outer legs and the main rails 12 and 13 have almost reached the end of their possible travel in the required direction.

Figure 4:
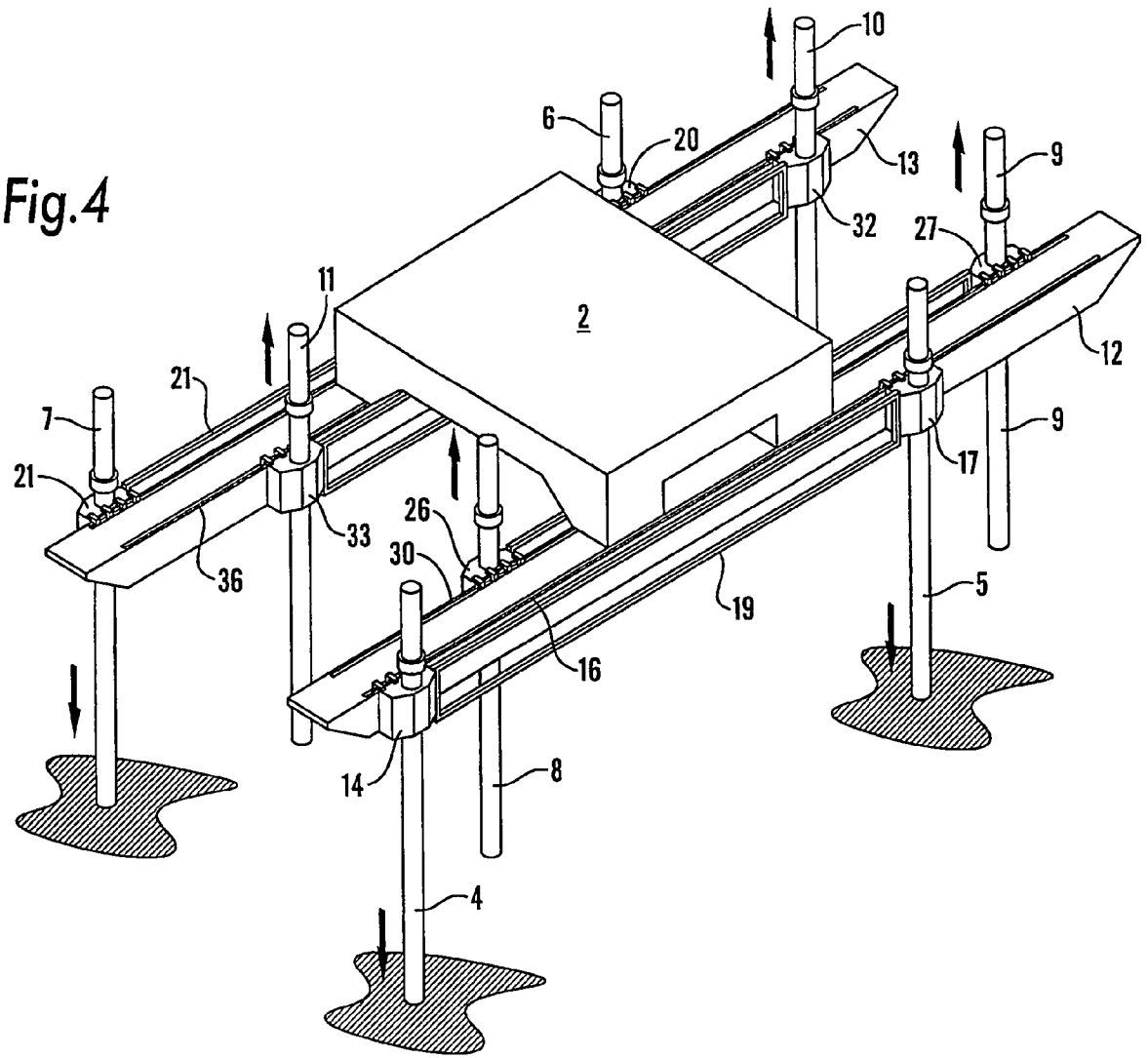
FIG. 4 illustrates the support structure when the outer set of legs are in their frame construction supporting positions and the inner set of legs are raised enabling displacement of the inner set of legs and the frame construction.

Once the outer legs 4,5, 6 and 7 and the main rails 12 and 13 have reached their limits of the travel to the left these outer legs 4, 5, 6 and 7 are lowered, as indicated by the arrows in FIG. 4, to their load supporting setting from the sea bed this being the point in the operational sequence as is illustrated by FIG. 4.

If, however, it is required further to displace the load platform further to the left the inner set of legs 8,9,10 and 11 would then be raised as indicated by the upwards directed arrows as shown in FIG. 4.

Figure 5:
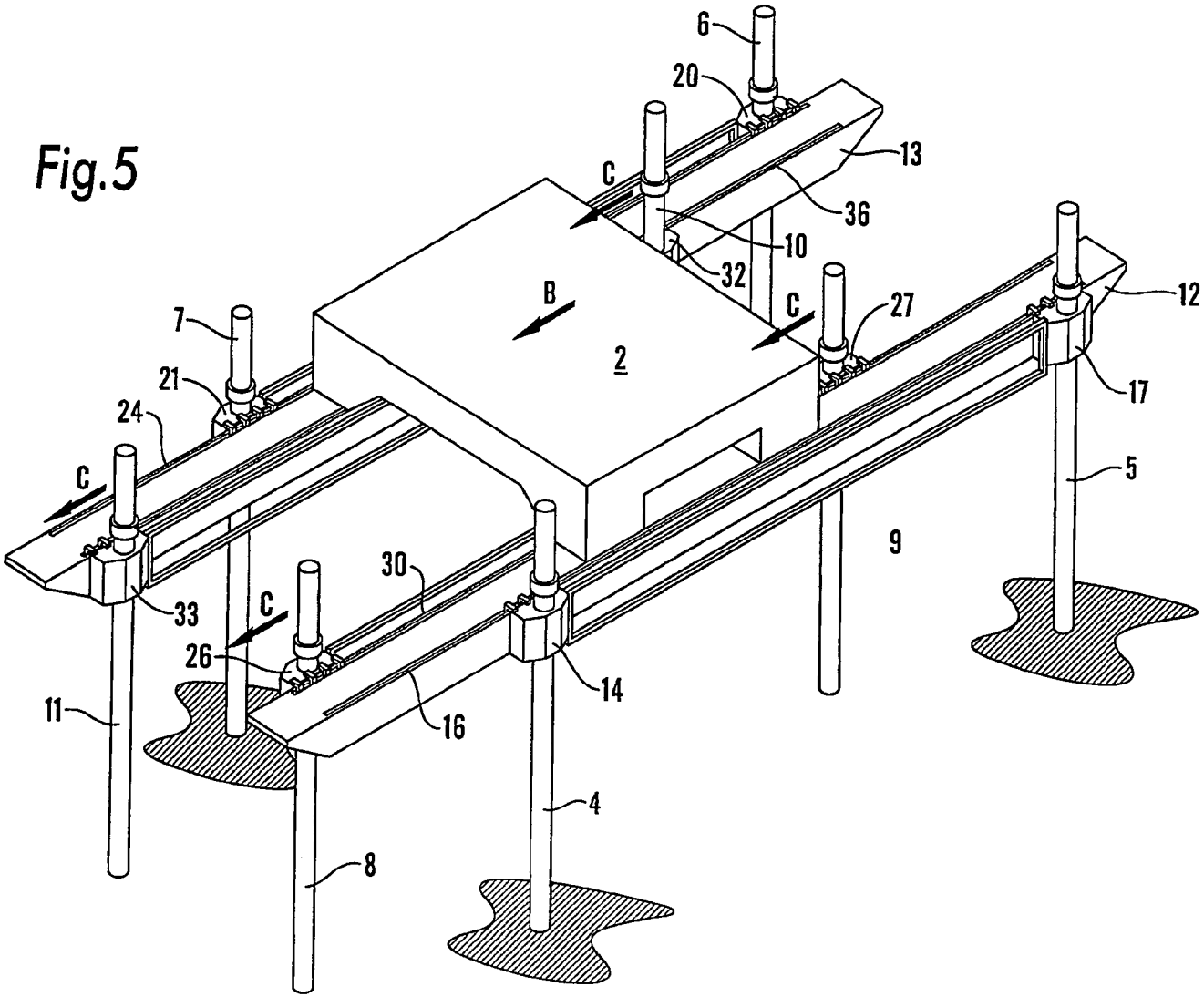
FIG. 5 illustrates the support structure when the outer set of legs are in their frame construction supporting positions and the inner set of legs are raised enabling displacement of the inner legs and the frame construction.

Once these sets of legs have been raised and the carriages 26,27,32 and 33 associated with the inner set of legs would be actuated to displace the main rails 12 and 13, the platform 2 and the inner set of legs 8,9,10 and 11 further to the left as is indicated by the arrows in FIG. 5 to the position shown in FIG. 5.

Figure 6:
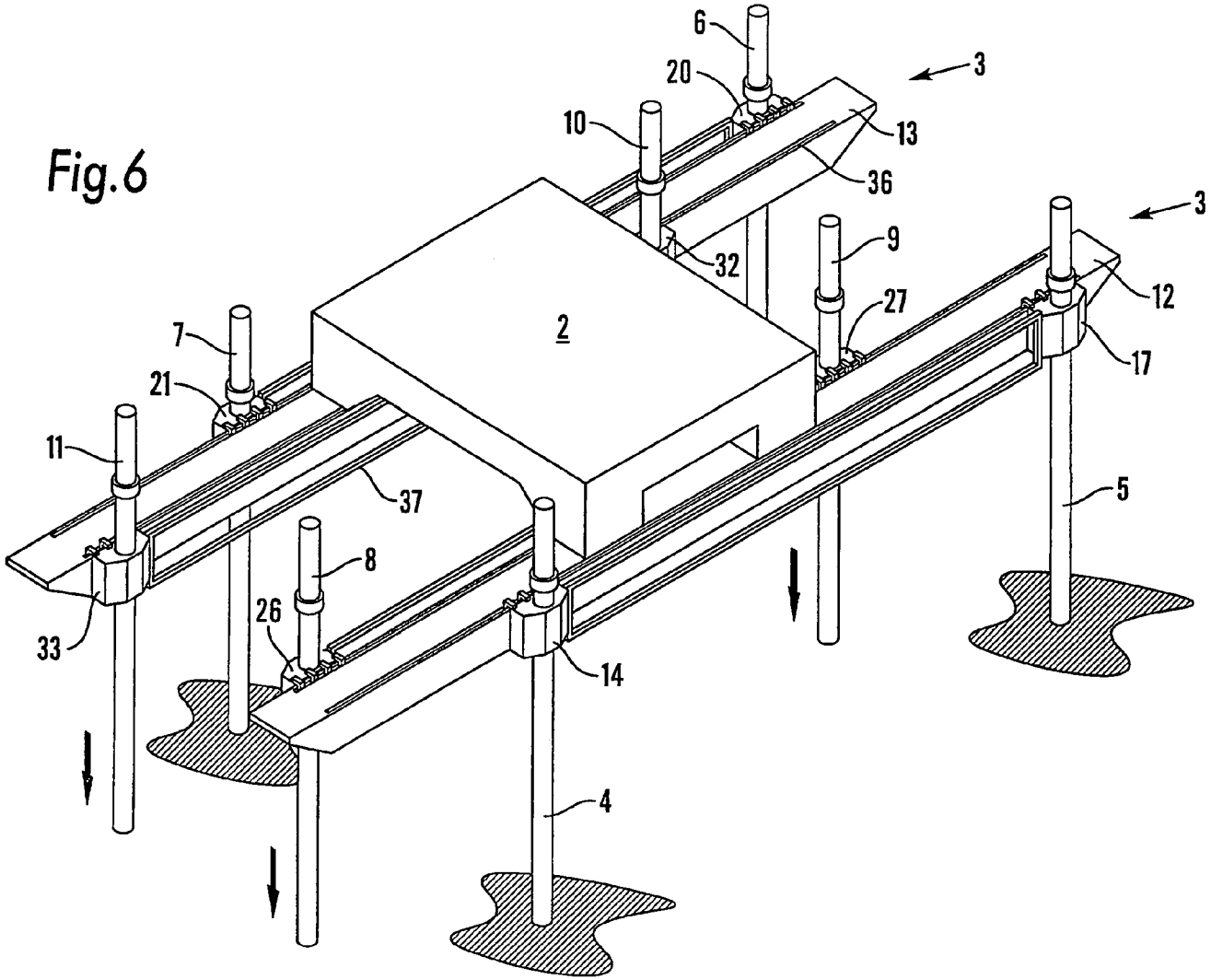

Once this position has been reached the outer set of legs 8,9,10 and 11 is lowered as shown in FIG. 6 so that load of the platform 2 and the frames 12 and 13 is distributed over the inner and outer set of legs. It will be noted that this is the position illustrated by effectively that illustrated in FIG. 1.

In other words once this condition has been reached the sequence of operations involved in moving the structure from one location to another location has been completed.

It should be noted that if considered convenient the lowering of the set of legs that has been raised can be initiated prior to the rails 12 and 13 having being moved to the limit of their travel to the left. This has an advantage that the time involved in a structure moving cycle is reduced thereby leading to faster movement/transportation of a load or equipment.

The above described sequence of movements has the effect of 'walking' the support structure from one location to another.

If it is required to move the structure to the right of the Figures the displacement of the framework construction and the main rails relative to the load carrying set of legs would be reversed as compared with that discussed in relation to FIGS. 1 to 6.

The above discussed sequences of operations can be utilised for the purposes of steering the structure.

One mode of effecting steering of the structure during its movement from one location to another can be achieved by moving the rail to one side of the structure a greater distance than the advancing movement applied to the other rail. This non-symmetrical movement has the effect of causing the structure to turn depart from a purely rectilinear path.

In a modification of the structure shown in the drawings and described above the carriages associated with the sets of legs can be of such construction such that each leg can be displaced towards and away from the associated main rail. This feature enables a small amount of sideways motion to be imparted to the overall structure so that by appropriate displacements of the legs to wards and away from the main rails the support structure can be steered.

In practice, the above described support structure provides a construction that facilities its use in relation to the operational displacement of the equipment that is submerged and needs to undergo positional displacement.

For example, in an underwater operation requiring the advance of the underwater equipment with respect to the sea bed it is often frequently necessary positionally displace the support structure to enable the required movements of the underwater equipment.

With the above described support structure in user applications in which a forwards and rearwards displacement is required for the purpose of an underwater operation to be carried out the provision of a platform that is itself readily displaceable lengthways of the supporting frame construction with out it being always necessary to undertake a sequence of leg raising and lowering considerably facilitates the ease of operation and also speed of operation.

The invention claimed is:

1. A displaceable load carrying structure for supporting a load adjacent a top surface of a body of water, the structure comprising a platform having an edge defining an outermost perimeter of the platform, a pair of parallel elongated supports fixed to respective opposite sides of the platform parallel to those sides and arranged to have respective portions which extend forwardly and rearwardly beyond the platform outer perimeter including free inner and outer edges perpendicular to forward and rearward edges of the platform outer perimeter, inner and outer pairs of carriages slidably mounted to the respective free inner and outer edges of each of the forward and rearward portions of the parallel elongated supports for reciprocal forward and rearward movement perpendicular to the forward and rearward edges of the platform, respective inner and outer sets of support legs connected to the inner and outer carriages for movement therewith, the inner and outer support legs being always located outside the platform outer perimeter, the legs being vertically movable between raised and lowered positions relative to the platform, the legs of each set being capable of supporting the platform when the legs of the other set are in a raised non-supporting position.

2. A displaceable load carrying structure as claimed in claim 1, wherein the support legs of either inner or outer set in their raised positions and the respective inner or outer carriage connected to the raised set of legs are displaceable along the respective free edges from a first location to another location whilst the other inner or outer support legs remain in their lowered position.

3. A displaceable load carrying structure as claimed in claim 2, and wherein each set of inner and outer support legs includes two pairs of legs, the legs of each pair being interconnected to enable simultaneous non-vertical displacement when raised for movement along the respective free edges.

4. A displaceable load carrying structure as claimed in either claim 1 or 2, further comprising a plurality of frame assemblies, each frame assembly extending between a single pair of the inner or outer carriages to space the carriages fixed thereto by a known distance from each other.

5. A displaceable load carrying structure as claimed in claim 4, wherein each of the frame assemblies are of uniform length to provide uniform spacing between each coupled pair of the carriages.

6. A displaceable load carrying structure as claimed in claim 4, wherein each frame assembly and respective pair of inner or outer carriages are movable relative to one of the elongated supports by a distance that is variable in relation to the movement of any other frame assembly.

7. A method of displacing a load carrying structure from one location to a second location, the load carrying structure including a platform having an edge defining an outermost perimeter of the platform, a pair of parallel elongated supports fixed to respective opposite sides of the platform parallel to those sides and arranged to have portions which extend forwardly and rearwardly beyond the platform outer perimeter including free inner and outer edges perpendicular to forward and rearward edges of the platform outer perimeter, inner and outer pairs of carriages slidably mounted to the respective free inner and outer edges of each of the forward and rearward portions of the parallel elongated supports for reciprocal forward and rearward movement perpendicular to the forward and rearward edges of the platform, respective inner and outer sets of support legs for supporting the platform and elongate supports, the support legs being vertically movable between raised and lowered positions relative to the platform, by a sequence of steps comprising vertically displacing the legs of the inner or outer set of support legs from a structure supporting lowered position, displacing the respective carriages connected to the raised legs relative to the respective free edge of the elongated fixed supports towards a desired second location the inner or outer sets of legs being always located outside the platform outer perimeter, returning the inner or outer sets of legs to structure supporting lowered positions, vertically displacing the other set of support legs from their structure supporting lowered positions to their raised positions, displacing the carriages of the raised other set of support legs relative to the respective free edge of the elongated supports towards the second location, the other set of support legs being always located outside the platform outer perimeter, and then lowering the raised other set of support legs to their lowered structure supporting position.

8. A method displacing a load carrying structure as claimed in claim 7, further comprising repeating the sequence of steps until the load carrying structure has been displaced to the said second location.

9. A method of displacing a load carrying structure as claimed in claim 7 or 8, and wherein the respective inner and outer pairs of support legs pair are relatively displaced with respect to the load carrying structure by the same amount.

10. A method of displacing a load carrying structure as claimed in claim 7 or 8, and wherein the respective inner and outer pairs of legs are arranged to be differently relatively displaced with respect to the load support arrangement to effect a steering displacement to the load carrying structure.

11. A method as claimed in claim 7 or 8, and further comprising the step of commencing to lower the raised set of support legs whilst the load support arrangement is being displaced relative to the other set of support legs that are in their lowered supporting position.

12. A method as claimed in claim 7 or 8, and including the step of individually displacing the support legs of a set for support leg position adjustment purposes.

13. A method as claimed in claim 7, wherein the pairs of inner and outer carriages are moved simultaneously to achieve a movement of the platform toward the second location and a further displacement of one of pairs of inner and outer carriages relative to the moving platform toward the second location.

14. A displaceable load carrying structure for supporting a load adjacent a top surface of a body of water, the structure comprising a platform having outermost edges defining an outer perimeter of the platform, a pair of parallel elongated supports fixed to respective opposite sides of the platform parallel to those sides and arranged to have respective portions which extend forward/ and rearward/beyond the platform perimeter, each respective portion of the elongated supports having an outside and an inside free edge extending perpendicular to forward and rearward edges of the platform outer perimeter, a pair of carriages slidably mounted to each of the inside and outside free edges of each elongated support, a frame assembly fixed to each pair of the carriages to space the carriages fixed thereto by a known distance from each other for reciprocal forward and rearward movement as a unit along one of the free edges of one of the elongated supports relative to the platform, a support leg coupled to each the carriages for movement therewith, the support legs being always located outside outer edges of the platform and vertically movable between a raised non-supporting position and a lowered position to support the platform.

15. A displaceable load carrying structure as claimed in claim 14, wherein a pair of carriages and frame assembly coupled to one elongated support is powered for simultaneous movement with a pair of carriages and frame assembly coupled to another elongated support.

16. A displaceable load carrying structure as claimed in either claim 14 or 15, wherein two pairs of the carriages and frame assemblies coupled to legs situated in the lowered position are controlled to move simultaneously to achieve a movement of the platform toward a desired location.

17. A displaceable load carrying structure as claimed in claim 16, wherein a pairs of carriages coupled to legs in the raised non-supporting position are controlled to move relative to the elongated supports along with said movement of the platform toward a desired location.

18. A displaceable load carrying structure as claimed in either claim 14 or 15, wherein the elongated supports are located on opposite sides of the platform, the carriages and frame assemblies coupled to the outsides free edges of the elongated supports being situated outside the lateral edges of the platform.

19. A displaceable load carrying structure as claimed in either claim 14 or 15, wherein the carriages are slidably mounted by way of rails to the elongated supports for defined linear movement of the carriages relative to the platform.

* * * * *

UNITED STATES PATENT AND TRADEMARK OFFICE

CERTIFICATE OF CORRECTION

PATENT NO. : 8,025,462 B2
APPLICATION NO. : 10/592843
DATED : September 27, 2011
INVENTOR(S) : John R. Y. Gleadowe et al.

It is certified that error appears in the above-identified patent and that said Letters Patent is hereby corrected as shown below:

In the Claims

Column 8, Line 10, please delete "fixed" before --supports--.

Column 8, Line 31, please delete "pair" after --legs--.

Column 8, Line 58, please delete "forward/" and insert --forwardly--.

Column 8, Line 58, please delete "rearward/" and insert --rearwardly--.

Column 10, Line 7, please delete "outsides" and insert --outside--.

Signed and Sealed this
Fifteenth Day of November, 2011

David J. Kappos
*Director of the United States Patent and Trademark Office*